US005086736A

United States Patent [19]

Wiemann

[11] Patent Number: 5,086,736

[45] Date of Patent: Feb. 11, 1992

[54] PISTON HEAD WITH BORES

[75] Inventor: Lothar Wiemann, Weinstadt, Fed. Rep. of Germany

[73] Assignee: Mahle GmbH, Stuttgart, Fed. Rep. of Germany

[21] Appl. No.: 694,414

[22] Filed: May 1, 1991

[30] Foreign Application Priority Data

May 8, 1990 [DE] Fed. Rep. of Germany ..... 4014703

[51] Int. Cl.[5] ..... F02F 3/22

[52] U.S. Cl. ..... 123/193.6; 92/186; 92/158; 92/159

[58] Field of Search ..... 123/193 P; 92/186, 158, 92/159, 216, 255

[56] References Cited

U.S. PATENT DOCUMENTS

| | | | |
|---|---|---|---|
| 3,259,028 | 7/1966 | Hutto | 92/158 |
| 4,013,057 | 3/1977 | Guenther | 123/193 P |
| 4,286,505 | 9/1981 | Amdall | 92/186 |
| 4,577,595 | 3/1986 | Deutschmann et al. | 123/193 P |
| 4,608,947 | 9/1986 | Stadler | 92/186 |
| 4,831,917 | 5/1989 | Houben et al. | 123/193 P |
| 4,947,805 | 8/1990 | Steppat et al. | 92/159 |

*Primary Examiner*—Raymond A. Nelli
*Assistant Examiner*—M. Macy
*Attorney, Agent, or Firm*—Collard, Roe & Galgano

[57] ABSTRACT

A piston for an internal combustion engine with a separate head and skirt which are joined by a piston pin. The ring belt extends downward from the head and terminates above the pin. The space between the lower edge of the ring belt and a section of the head defines a cooling oil ring space. The head is provided with bores which extend from the cooling oil ring space upward toward the top of the head.

7 Claims, 3 Drawing Sheets

PISTON HEAD WITH BORES

BACKGROUND OF THE INVENTION

1. Field of the Invention

The invention relates to a cooled piston for internal combustion engines with a separate piston head and piston skirt. More particularly, it relates to a steel or iron piston head joined to the piston skirt by means of the piston pin. The underside of the piston head is provided with bores.

2. Summary of the Invention

It is an object of the present invention to provide a piston which has improved heat transfer from the piston head and ring belt to the engine block.

These and other related objects are attained according to the invention by a piston for internal combustion engines with a separate piston head and piston skirt. The steel or iron head is joined to the skirt by means of the piston pin. A ring belt, into which the ring grooves are set, projects downward from the head and terminates above the pin. The ring belt defines an outer border of a cooling oil ring space. The inner border of the ring space is defined by a section of the head which is an extension of the piston base. This section is located over two hubs which form a mount for the pin. A depression is formed in the head and base and is partly defined by the section.

In the area of the cooling oil ring space, bores are provided which extend upward toward the top of the head. Advantageously, the bores increase the surface area of the underside of the head and allow more efficient cooling.

BRIEF DESCRIPTION OF THE DRAWINGS

Other objects and features of the present invention will become apparent from the following detailed description considered in connection with the accompanying drawing which discloses an embodiment of the present invention. It should be understood, however, that the drawing is designed for the purpose of illustration only and not as a definition of the limits of the invention.

DETAILED DESCRIPTION OF PREFERRED EMBODIMENTS

Figure 1:
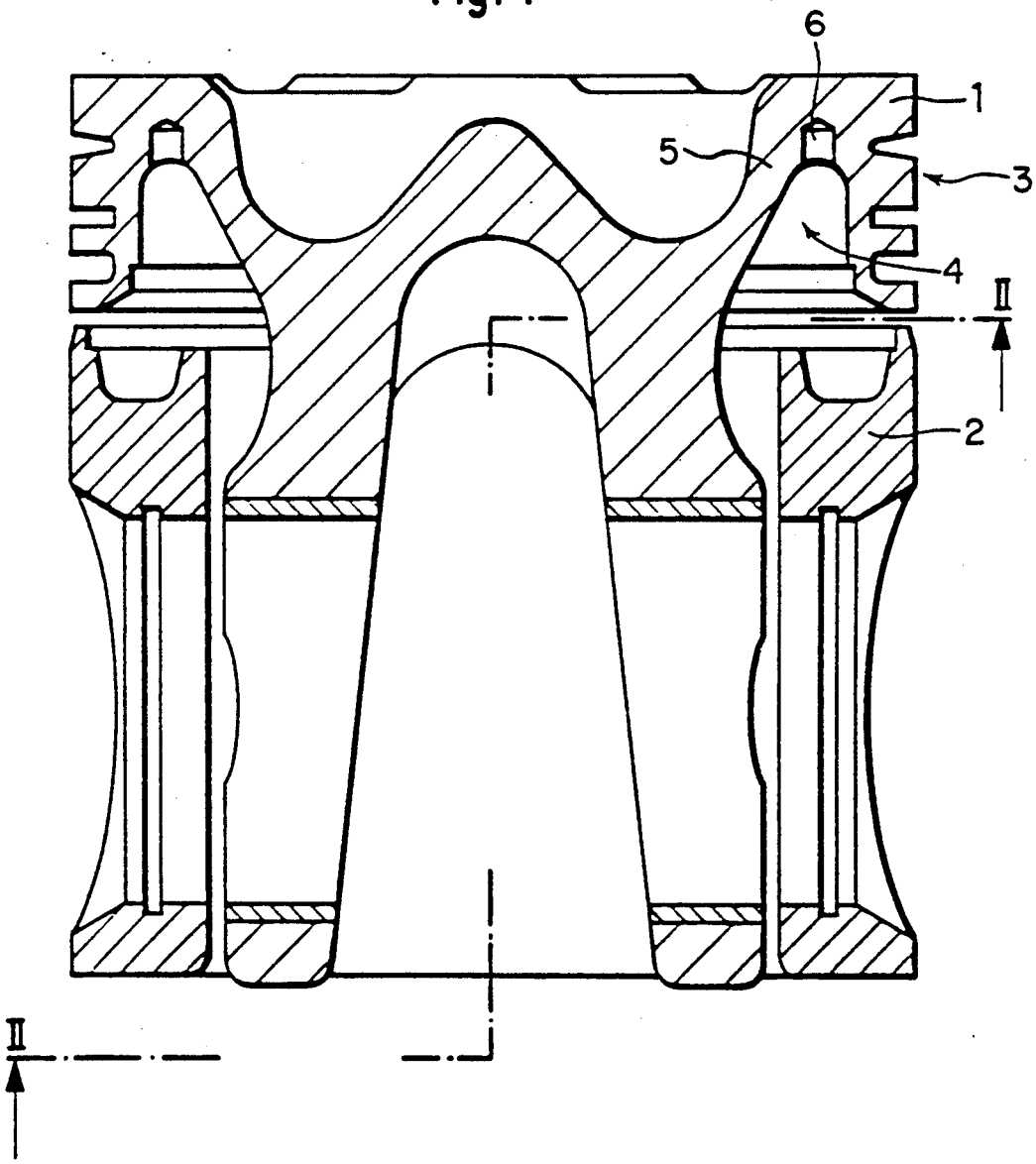
FIG. 1 is a longitudinal cross-sectional view of a piston head and skirt embodying the present invention.
Figure 2:
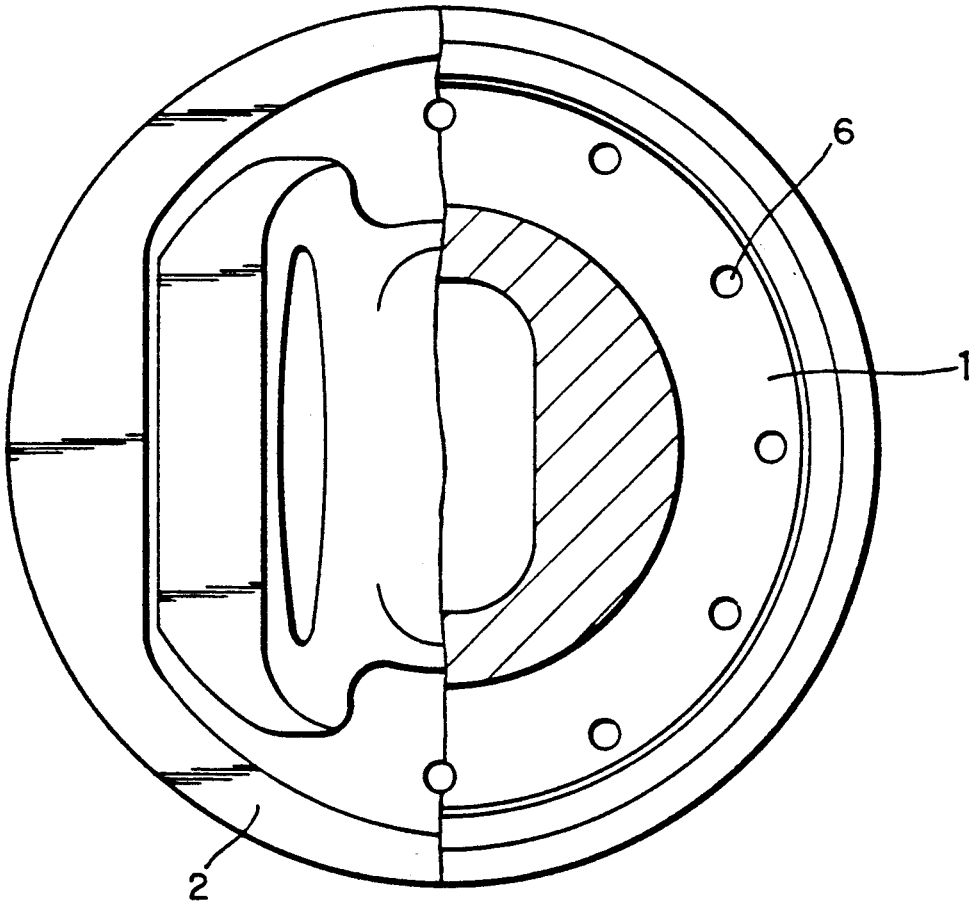
FIG. 2 is a bottom elevational view, in part section.
Figure 3:
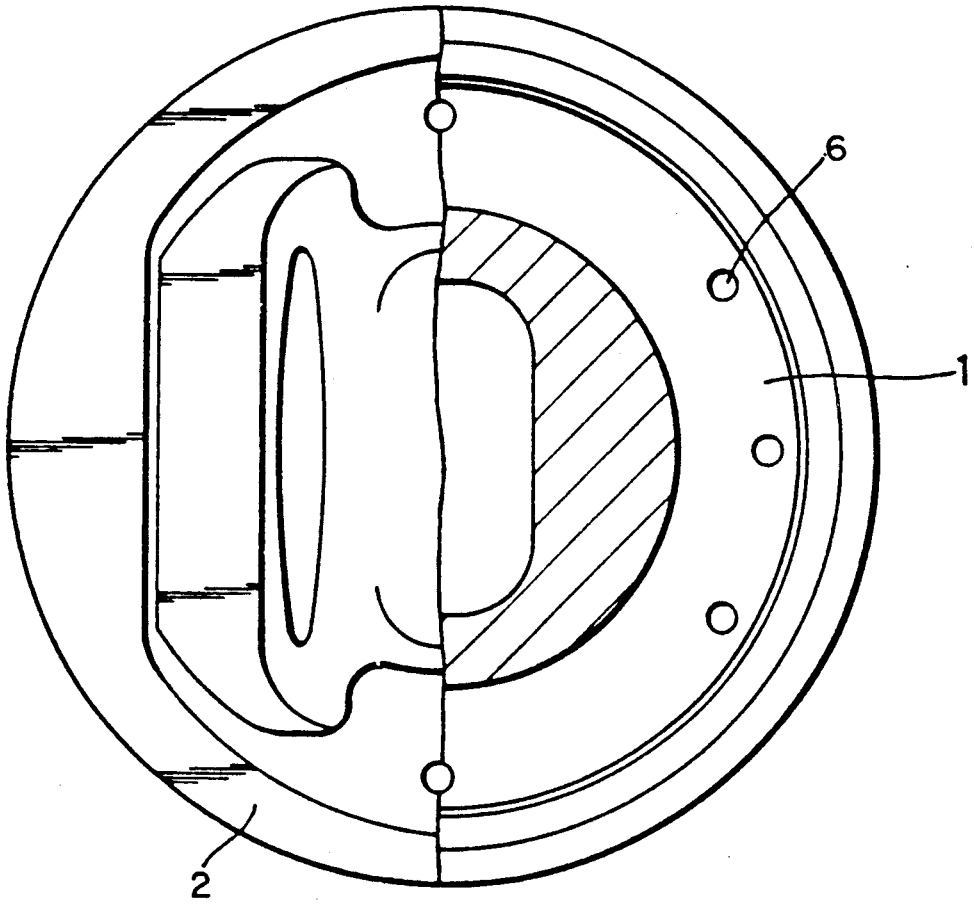
FIG. 3 is a bottom elevational view, in part section, of an alternate embodiment.

Turning now in detail to the drawings, and, in particular, FIGS. 1, 2 and 3 there is illustrated a piston, embodying the present invention consisting of a piston head 1, for example, made from forged steel or iron, and a piston skirt 2, for example, made from aluminum.

Head 1 and skirt 2 are connected together by means of a piston pin (not shown for reasons of clarity) and joined to the connecting rod of the engine. A ring belt 3 extends downward from head 1. It is radially distanced from the piston base and ends axially a short distance above skirt 2.

Ring belt 3 defines an outer border of a cooling oil ring space 4, which has an open bottom end. The bottom end can also be closed, i.e., connected to the head. The inner border of cooling oil ring space is defined by a section 5 of the head which extends from the piston base. The top of cooling oil ring space 4 is provided with bores 6 which extend upward toward the top of head 1. Bores 6 can be of any depth and are generally parallel to the longitudinal axis of the piston. Bores 6 can be machined uniformly or non-uniformly over the circumference of space 4, for example.

While only one embodiment of the present invention has been shown and described, it is to be understood that many changes and modifications may be made thereunto without departing from the spirit and scope of the invention as defined in the appended claims.

What is claimed is:

1. In an improved piston for an internal combustion engine with a separate head and skirt which are joined by a piston pin, a ring belt extends downward from the head and terminates above the pin, the ring belt defines an outer border of a cooling oil ring space, a section of the head extending from the piston base defines the inner border of the space, a bottom free end of the ring belt is detached from the head, a depression is formed in the head and is partly defined by the section, the improvement comprising:

the head is provided with bores which extend essentially vertically upward from the cooling oil ring space toward the top of the head.

2. The piston according to claim 1, wherein the head is made of steel.

3. The piston according to claim 1, wherein the head is made of iron.

4. The piston according to claim 1, wherein the skirt is made of aluminum.

5. The piston according to claim 1, wherein the bores are generally parallel to a longitudinal axis of the piston.

6. The piston according to claim 5, wherein the bores are distributed uniformly over the circumference of the cooling oil ring space.

7. The piston according to claim 5, wherein the bores are distributed non-uniformly over the circumference of the cooling oil ring space.

* * * * *